US007342554B2

(12) United States Patent
Hsu et al.

(10) Patent No.: US 7,342,554 B2
(45) Date of Patent: Mar. 11, 2008

(54) COLUMN ANTENNA APPARATUS AND A MANUFACTURING METHOD THEREOF

(75) Inventors: Kang-Neng Hsu, Hsinchu (TW); Chien-Hsun Wu, Hsinchu (TW); Ming-Yu Chien, Hsinchu (TW); Chih-Ming Chen, Hsinchu (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 159 days.

(21) Appl. No.: 11/286,336

(22) Filed: Nov. 25, 2005

(65) Prior Publication Data

US 2007/0120760 A1 May 31, 2007

(51) Int. Cl.
*H01Q 1/36* (2006.01)

(52) U.S. Cl. ..... 343/895; 343/702; 343/895; 343/900; 343/901

(58) Field of Classification Search ..... 343/895, 343/702, 749, 866, 872, 900, 846, 829, 830
See application file for complete search history.

(56) References Cited

U.S. PATENT DOCUMENTS 4,323,900 A * 4/1982 Krall et al. ..... 343/700 MS
4,511,843 A * 4/1985 Thoraval ..... 324/338
5,859,621 A * 1/1999 Leisten ..... 343/895
5,914,697 A * 6/1999 Seki ..... 343/895
6,285,340 B1 * 9/2001 Park et al. ..... 343/895
6,300,917 B1 * 10/2001 Leisten et al. ..... 343/895
6,788,271 B1 * 9/2004 Koo et al. ..... 343/895
7,132,998 B2 * 11/2006 Ryou et al. ..... 343/895

* cited by examiner

*Primary Examiner*—Douglas W. Owens
*Assistant Examiner*—Chuc Tran
(74) *Attorney, Agent, or Firm*—Rosenberg, Klein & Lee

(57) ABSTRACT

A column antenna apparatus and a manufacturing method thereof are disclosed. This invention forms a spiral metal layer on a column body. The column antenna apparatus can simplify the manufacturing process and enhance the yield rate. The column antenna apparatus includes a column body, a metal layer and a spiral structure. The metal layer is formed on the surface of the column body, and the spiral structure is formed on the metal layer. The spiral structure is implemented by removing part of the metal layer to form a pitch structure. The column body is exposed between the pitches. The column antenna apparatus can be applied to a single, dual, three or multi frequencies wireless communication device. Furthermore, the column antenna apparatus can be installed at outside of the wireless communication device to be an external antenna or at inside of the wireless communication device to be a built-in antenna.

28 Claims, 4 Drawing Sheets

COLUMN ANTENNA APPARATUS AND A MANUFACTURING METHOD THEREOF

BACKGROUND OF THE INVENTION

1. Field of the Invention

The present invention relates to a column antenna apparatus and a manufacturing method thereof. In particular, this invention relates to an antenna apparatus that forms a spiral metal layer on a column body.

2. Description of the Related Art

Due to the development of the communication technology, a lot of electronic products that adopt the wireless communication technology are developed, such as cell phones, wireless Internet devices and personal digital assistant (PDA) etc. The requirements for the wireless communication devices come from the consumers has become higher and higher, such as the effect, the appearance, and dimension. For cell phones, the receiving frequency has developed from single, two to three, four frequencies. The consumers also requests the cell phones has the characteristics, including fresh appearance, small dimension, light weight, and easy carry. Moreover, the receiving-signal effect of the wireless communication devices is an important index for evaluating the wireless communication devices and the antenna apparatus is a key factor to determine the receiving-signal effect of the wireless communication devices. Therefore, it is an important factor to develop an antenna apparatus that has an excellent receiving-signal effect and meets with the requirement of fresh appearance and small dimension.

FIG. 1 shows an antenna structure of a wireless communication device of the prior art. Firstly, a spiral coil 10 is formed (as shown in the FIG. 2). Then, a fastening layer 12 is formed by a projecting method with a plastic material. Therefore, the spiral coil 10 is fastened to a screw base 14. Finally, a plastic layer 16 is wrapped to provide the functions, including protection and good appearance.

However, the spiral coil 10 has the deformation problem during the shipment. The deformation of the spiral coil will affect the receiving frequency and the quality of the antenna. Furthermore, in the projecting process, the spiral coil 10 also is deformed due to the force come from the plastic material. The receiving frequency and the quality of the antenna may be changed due to the deformation of the spiral coil. Therefore, the quality of the antenna cannot be controlled well during the manufacturing process. Moreover, due to the structure of the antenna, the dimension of the antenna cannot be further shrunk.

SUMMARY OF THE INVENTION

One particular aspect of the present invention is to provide a column antenna apparatus and a manufacturing method thereof. This invention forms a spiral metal layer on a column body. The column antenna apparatus of the present invention can simplify the manufacturing process and enhance the yield rate.

Another particular aspect of the present invention is to provide a column antenna apparatus and a manufacturing method thereof. It forms a column body by using ceramic material. A metal layer is electroplated on the column body. Then, a spiral structure is formed on the metal layer. The structure of the column antenna apparatus of the present invention is simple. Therefore, the cost is reduced.

Further particular aspect of the present invention is to provide a column antenna apparatus and a manufacturing method thereof. This invention forms a spiral metal layer on a column body. By adjusting the pitch of the spiral structure, the spiral structure of the metal layer has a single pitch or a plurality of pitches. Therefore, the column antenna apparatus of the present invention can be applied to a wireless communication device having a single frequency, dual frequencies or multi frequencies, and the manufacturing method for producing multi pitches can be easily implemented.

Further particular aspect of the present invention is to provide a column antenna apparatus and a manufacturing method thereof. This invention forms a spiral metal layer on a column body. Its structure is simple. The dimension of the antenna can be shrunk according to the demand. Therefore, the column antenna apparatus of the present invention can be installed at outside of the wireless communication device to be an external type antenna. Alternatively, the column antenna apparatus can be installed at inside of the wireless communication device to be a built-in antenna. Thereby, the column antenna apparatus of the present invention can be installed at the wireless communication device with a variety of types to provide an excellent quality of receiving signal.

The column antenna apparatus of the present invention includes a column body, a metal layer and a spiral structure. The metal layer is formed on the surface of the column body, and the spiral structure is formed on the metal layer. The spiral structure is implemented by removing part of the metal layer to form a pitch structure. The column body is exposed between the pitches.

The column antenna apparatus of the present invention includes a column body, a metal layer, a spiral structure, a screw base and a shell. The column body is made of ceramic. The metal layer is formed on the surface of the column body, and the spiral structure is formed on the metal layer. The screw base is used for supporting the column body and the shell is used for wrapping the column body.

The manufacturing method for a column antenna apparatus of the present invention includes forming a column body, forming a metal layer on the surface of the column body, and forming a spiral structure on the metal layer. The spiral structure is implemented by removing part of the metal layer to form a pitch structure, and the column body is exposed between the pitches.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
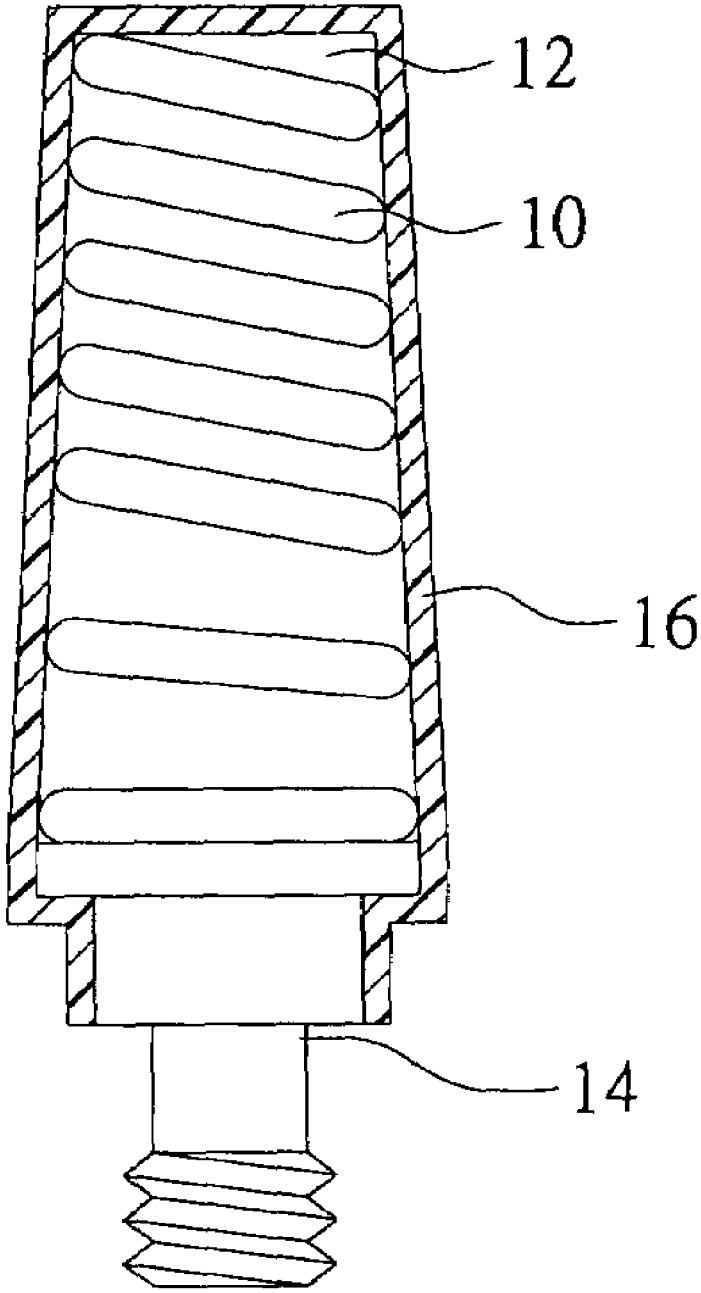
FIG 1 PRIOR ART
FIG. 1 is a schematic diagram of an antenna structure of a wireless communication device of the prior art.
Figure 2:
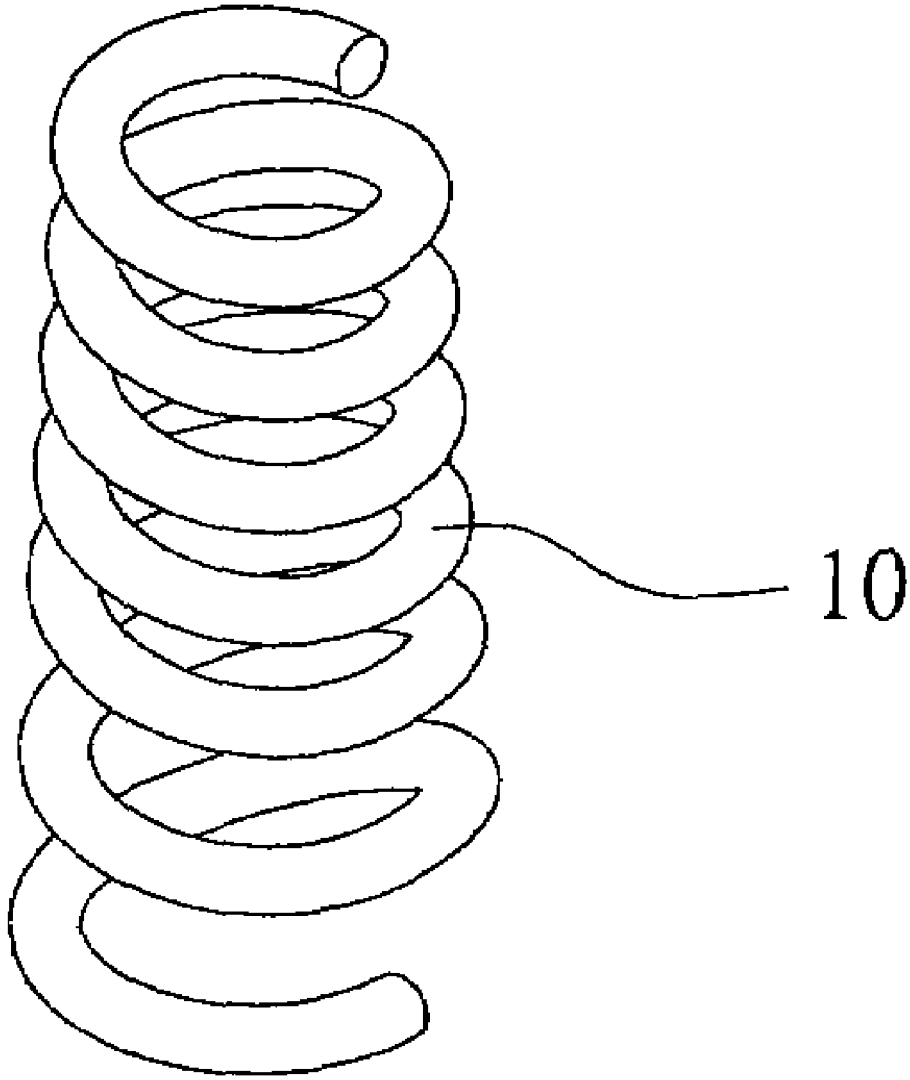
FIG 2 PRIOR ART
FIG. 2 is a schematic diagram of a spiral coil of the antenna structure of a wireless communication device of the prior art.
Figure 3:
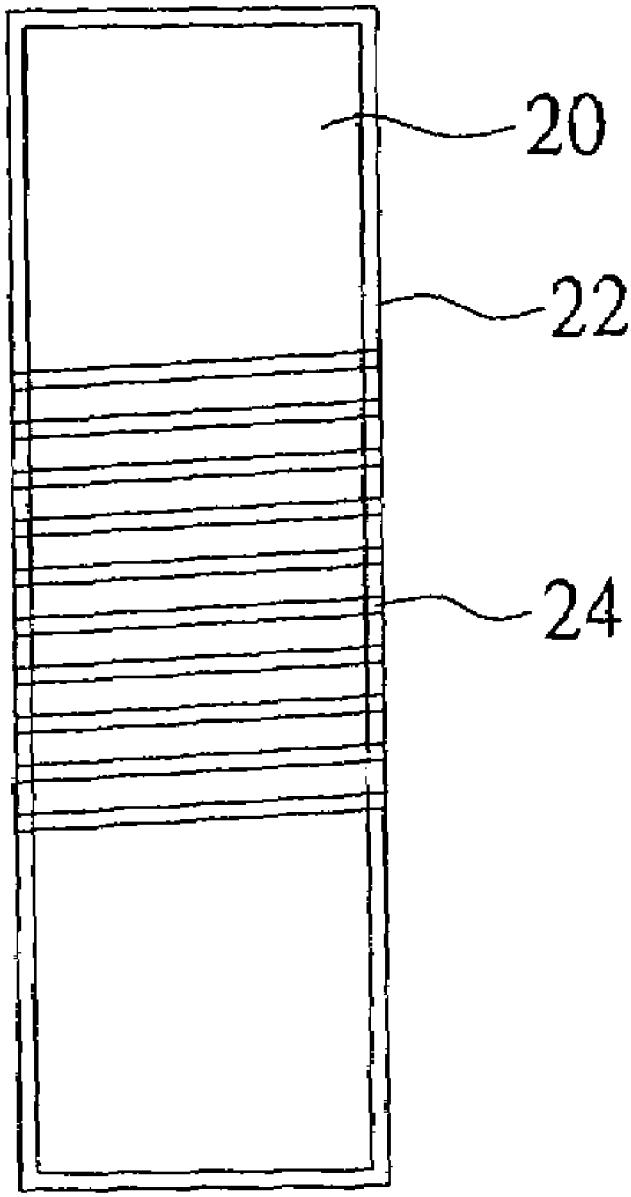
FIG. 3 is a schematic diagram of a first embodiment of the column antenna apparatus of the present invention.

Please refer to FIG. 3, which shows a schematic diagram of a first embodiment of the column antenna apparatus of the present invention. The column antenna apparatus of the present invention includes a column body 20, a metal layer 22 and a spiral structure 24. The material of the column body 20 is ceramic or other materials that have the characteristics of insulation and being electroplated. The metal layer 22 is formed on the surface of the column body 20 and wraps all of the column body 20. The material of the metal layer 22 is copper, gold or other materials that have the characteristic of good electric conductivity. The metal layer 22 is formed on the surface of the column body 20 by electroplating. The spiral structure 24 is formed on the metal layer 22. The spiral structure 24 is implemented by removing part of the metal layer 22 to form a pitch structure. The column body 20 is exposed between the pitches.

By adjusting the pitch of the spiral structure 24 of the column antenna apparatus of the present invention, the column antenna apparatus of the present invention can be applied to a wireless communication device having a single frequency, dual frequencies, three frequencies or multi frequencies. When the pitch of the spiral structure 24 of the column antenna apparatus is identical, the column antenna apparatus is a single frequency antenna. When the spiral structure 24 of the column antenna apparatus has two different pitches, the column antenna apparatus is a dual frequency antenna. When the spiral structure 24 of the column antenna apparatus has more than two different pitches, the column antenna apparatus is a multi frequency antenna. The column antenna apparatus can be used in a wireless communication that receives multi frequency signals, such as a three frequencies cell phone supporting 900, 1800 and 1900 MHz.

Furthermore, the column antenna apparatus of the present invention can be applied to an external antenna. Due to the structure of the column antenna apparatus is simple, the dimension of the column antenna apparatus can be shrunk according to the demand. Therefore, the column antenna apparatus of the present invention can be installed on the circuit board located in the wireless communication device to form a built-in antenna, namely a hidden antenna.

Figure 4:
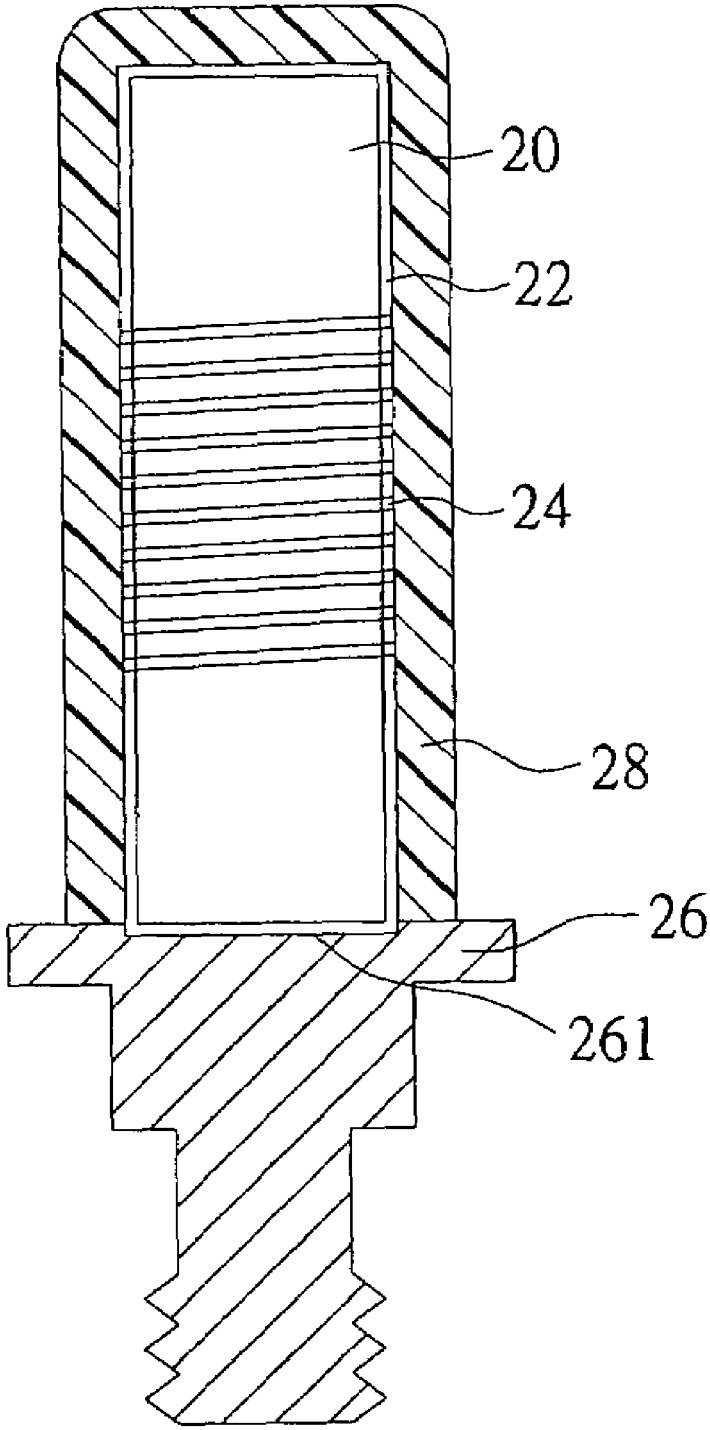
FIG. 4 is a schematic diagram of a second embodiment of the column antenna apparatus of the present invention.

Please refer to FIG. 4, which shows a schematic diagram of a second embodiment of the column antenna apparatus of the present invention. The column antenna apparatus of the present invention further includes a screw base 23 having concave space 261 for supporting the column body 20. The column body 20 is fastened in the concave space 261 of the screw base 26 by a welding process to enhance the connection strength between the column body 20 and the screw base 26. Therefore, the strength of anti-dropping is also enhanced. Moreover, in order to fit with the industrial design of the appearance dimension, a shell 28 is formed on the column body 20 and is made of plastic. The shell 28 has the functions, including excellent appearance and protection.

The manufacturing method for a column antenna apparatus of the present invention includes forming a column body 20 by using ceramic. Then, a metal layer 22 is formed on the surface of the column body 20 by electroplating, such as a copper layer or a gold layer. Further, a spiral structure 24 is formed on the metal layer 22 by a lathing. The spiral structure 24 is implemented by removing part of the metal layer 22 to form a pitch structure, and the column body is exposed between the pitches. By adjusting the program of the lathe, the spiral structure 24 can have a single pitch or multi pitches to form a single, dual or multi frequencies antenna. Then, a screw base 26 having a concave space 261 is manufactured. The screw base 26 is used for supporting the column body 20 and fastens the column body 20 in the concave space 261 of the screw base 26 by welding. Finally, a shell 28 is formed by using the plastic material to wrap the column body 20.

The column antenna apparatus and a manufacturing method thereof of the present invention has the following characteristics:

1. The column antenna apparatus of the present invention forms a spiral metal layer on a column body to simplify the manufacturing process and increase the yield rate.

2. The structure of the column antenna apparatus of the present invention is simple. Therefore, the cost is reduced.

3. By adjusting the pitch of the spiral structure, the column antenna apparatus of the present invention can be applied to a single, dual, three or multi frequencies wireless communication device.

4. The structure of the column antenna apparatus of the present invention is simple and can be shrunk according to the demand. Therefore, the column antenna apparatus of the present invention can be used for an external antenna or a built-in antenna.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A column antenna apparatus, comprising:

a column body;

a metal layer formed on the surface of the column body;

a screw base having a concave space for supporting the column body; and a spiral structure formed on the metal layer;

wherein the spiral structure is implemented by removing part of the metal layer to form a pitch structure, and the column body is exposed between the pitches.

2. The column antenna apparatus as claimed in claim 1, wherein the column body is made of ceramic.

3. The column antenna apparatus as claimed in claim 1, wherein the metal layer is made of copper.

4. The column antenna apparatus as claimed in claim 1, wherein the metal layer is made of gold.

5. The column antenna apparatus as claimed in claim 1, wherein the metal layer is formed on the surface of the column body by electroplating.

6. The column antenna apparatus as claimed in claim 1, wherein the spiral structure has a single pitch.

7. The column antenna apparatus as claimed in claim 1, wherein the spiral structure has a plurality of pitches.

8. The column antenna apparatus as claimed in claim 1, wherein the column body is fastened in the concave space of the screw base by welding.

9. The column antenna apparatus as claimed in claim 1, further comprising a shell for wrapping the column body.

10. The column antenna apparatus as claimed in claim 9, wherein the shell is made of plastic.

11. A manufacturing method for a column antenna apparatus, the steps comprising:

forming a column body;

forming a metal layer on the surface of the column body;

manufacturing a screw base having a concave space for supporting the column body, and forming a spiral structure on the metal layer.

12. The manufacturing method for a column antenna apparatus as claimed in claim 11, wherein the step of forming a spiral structure on the metal layer is implemented by lathing, and removes part of the metal layer to form a pitch structure, and the column body is exposed between the pitches.

13. The manufacturing method for a column antenna apparatus as claimed in claim 11, wherein the column body is made of ceramic.

14. The manufacturing method for a column antenna apparatus as claimed in claim 11, wherein the metal layer is made of copper.

15. The manufacturing method for a column antenna apparatus as claimed in claim 11, wherein the metal layer is made of gold.

16. The manufacturing method for a column antenna apparatus as claimed in claim 11, wherein the step of forming the metal layer on the surface of the column body is implemented by electroplating.

17. The manufacturing method for a column antenna apparatus as claimed in claim 11, wherein the spiral structure has a single pitch.

18. The manufacturing method for a column antenna apparatus as claimed in claim 11, wherein the spiral structure has a plurality of pitches.

19. The manufacturing method for a column antenna apparatus as claimed in claim 11, further comprising a welding process to fasten the column body in the concave space of the screw base.

20. The manufacturing method for a column antenna apparatus as claimed in claim 11, further comprising a step of forming a shell for wrapping the column body.

21. The manufacturing method for a column antenna apparatus as claimed in claim 20, wherein the shell is made of plastic.

22. A column antenna apparatus, comprising:

a column body made of ceramic;

a metal layer formed on the surface of the column body by electroplating;

a spiral structure formed on the metal layer;

wherein the spiral structure is implemented by removing part of the metal layer to form a pitch structure, and the column body is exposed between the pitches; a screw base having a concave space for supporting the column body; and a shell used for wrapping the column body.

23. The column antenna apparatus as claimed in claim 22, wherein the metal layer is made of copper.

24. The column antenna apparatus as claimed in claim 22, wherein the metal layer is made of gold.

25. The column antenna apparatus as claimed in claim 22, wherein the spiral structure has a single pitch.

26. The column antenna apparatus as claimed in claim 22, wherein the spiral structure has a plurality of pitches.

27. The column antenna apparatus as claimed in claim 22, wherein the column body is fastened in the concave space of the screw base by welding.

28. The column antenna apparatus as claimed in claim 22, wherein the shell is made of plastic.

* * * * *